United States Patent [19]

Turner

[11] 4,062,755

[45] Dec. 13, 1977

[54] ELECTROPLATING ANODE PLENUM

[75] Inventor: Dennis Robert Turner, Chatham Township, Morris County, N.J.

[73] Assignee: Bell Telephone Laboratories, Incorporated, Murray Hill, N.J.

[21] Appl. No.: 682,729

[22] Filed: May 3, 1976

[51] Int. Cl.[2] ..... C25C 1/08; C25C 7/02

[52] U.S. Cl. ..... 204/275; 204/49; 204/225; 204/284

[58] Field of Search ..... 204/225, 259, 263, 269, 204/275, 284, 49, 285, 232, 234, 237

[56] References Cited

U.S. PATENT DOCUMENTS

| | | | |
|---|---|---|---|
| 669,439 | 3/1901 | Frasch | 204/237 |
| 1,765,706 | 6/1930 | Stewart et al. | 204/285 |
| 3,450,625 | 6/1969 | Ramsey et al. | 204/237 |
| 3,617,449 | 11/1971 | Giles | 204/49 X |
| 3,875,041 | 4/1975 | Harvey et al. | 204/273 |
| 3,894,924 | 7/1975 | Toledo | 204/275 X |

*Primary Examiner*—Arthur C. Prescott
*Attorney, Agent, or Firm*—Allen N. Friedman

[57] ABSTRACT

The anode of an electroplating apparatus is incorporated in a sparging plenum. The plenum has an insulating partition separating the anodically biased electrode from the workpieces being plated. The partition has a regular array of orifices. Electrolyte is pumped into the plenum and flows out of the partition, providing a spacially uniform supply of fresh solution to the workpieces. In a soluble anode process, the solution is replenished in the plenum. In an exemplary apparatus, one major surface of the plenum is a titanium tray, which holds pieces of nickel, which dissolve during the nickel plating process.

4 Claims, 3 Drawing Figures

ELECTROPLATING ANODE PLENUM

BACKGROUND OF THE INVENTION

1. Field of the Invention

The invention is in the field of electroplating apparatus, more particularly, electroplating anode structures.

2. Brief Description of the Prior Art

The pumping of electrolyte through a perforated partition during electrolytic processing has been used in the art for various purposes. For example, U.S. Pat. No. 1,792,197, issued Feb. 10, 1931, discloses the forcing of electrolyte through holes in an article being plated in order to assure deposition of plated material on the walls of the holes. In addition, in an electrolyte metal extraction process (U.S. Pat. No. 3,483,568, issued Dec. 16, 1969) a solution, including the metal to be extracted, was pumped through holes in a partition in order to regulate the flow of the solution across the anodes and cathodes in order to produce the desired fluid flow pattern in the anode-cathode area. In this extraction method both the anodes and cathodes are situated on the same side of the partition.

However, none of this art contemplates the use of a perforated partition to produce uniform flow of fresh electroplating solution form the anode to the cathode region of an electroplating apparatus.

SUMMARY OF THE INVENTION

An anode plenum has been developed which provides a uniform flow of fresh electroplating solution from the plating anodes to the workpieces being plated. The plenum includes a partition with a regular array of orifices. The partition is situated between the anodically biased electrode and the workpieces being plated. The least dimension of the plenum is large enough to produce essentially uniform fluid pressure across the entire partition so that the fluid flow through each of the orifices is not significantly different from one portion of the partition to another. This uniform flow pattern is as opposed to the flow pattern which would be obtained by pumping the electrolyte through long perforated tubes. In an insoluable anode process this uniform flow of fresh solution continually replaces the depleted solution in the immediate neighborhood of the workpieces during plating. In a soluble anode process anodically biased metal pieces in the plenum continually dissolve to replenish the solution. The replenished solution flows uniformally to the workpieces. In one exemplary apparatus one major surface of the anode consists of an insoluble tray (e.g., titanium), which is anodically biased and holds pieces of the soluble metal being plated (e.g., nickel).

DETAILED DESCRIPTION OF THE INVENTION

Figure 1:
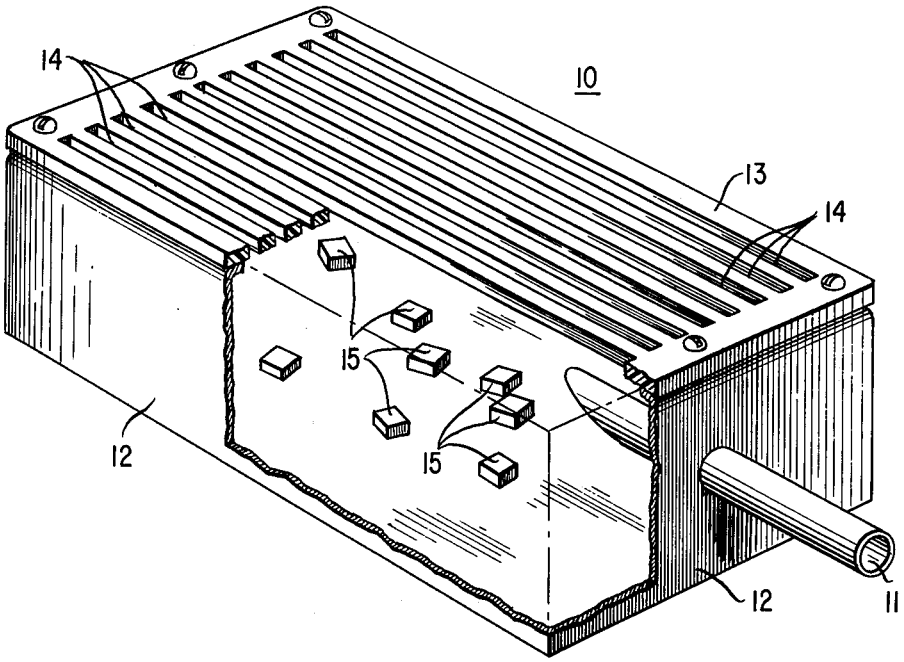
FIG. 1 is a partially cut away perspective view of an exemplary anode plenum.

The electroplating apparatus of the invention are intended to provide a unifrom flow of plating solution from the region of the plating anodes to the region of the workpieces being plated. In electroplating processes it is common to include some means for continual circulation or stirring of the electrolyte. This process is commony referred to as sparging. In the appartus of the invention a primary intent is to provide, as nearly as possible, uniform flow of the electrolyte from the region of the anode to the workpieces being plated. This is accomplished by placing a perforated partition between the anode or anodes and the workpieces being plated and forcing electrolyte to flow through the partition. In order to accomplish this a sparging plenum, such as is illustrated in FIG. 1, is provided. Electrolyte is continually pumped into the plenum 10 through a suitable inlet 11. The plenum 10 incorporates an anode structure 12 (here illustrated as an open topped metal box) and a perforated insulating partition 13, the juncture between the box 12 and the partition 13 being so constructed as to provide means for restricting the flow of electrolyte to be at least principally through the orifices 14 in the partition 13. In an insoluble anode plating process the plenum can be used as described above. In a soluble anode plating process the box 12 holds pieces 15 of the metal being plated. These pieces dissolve as the plating progresses.

Figure 2:
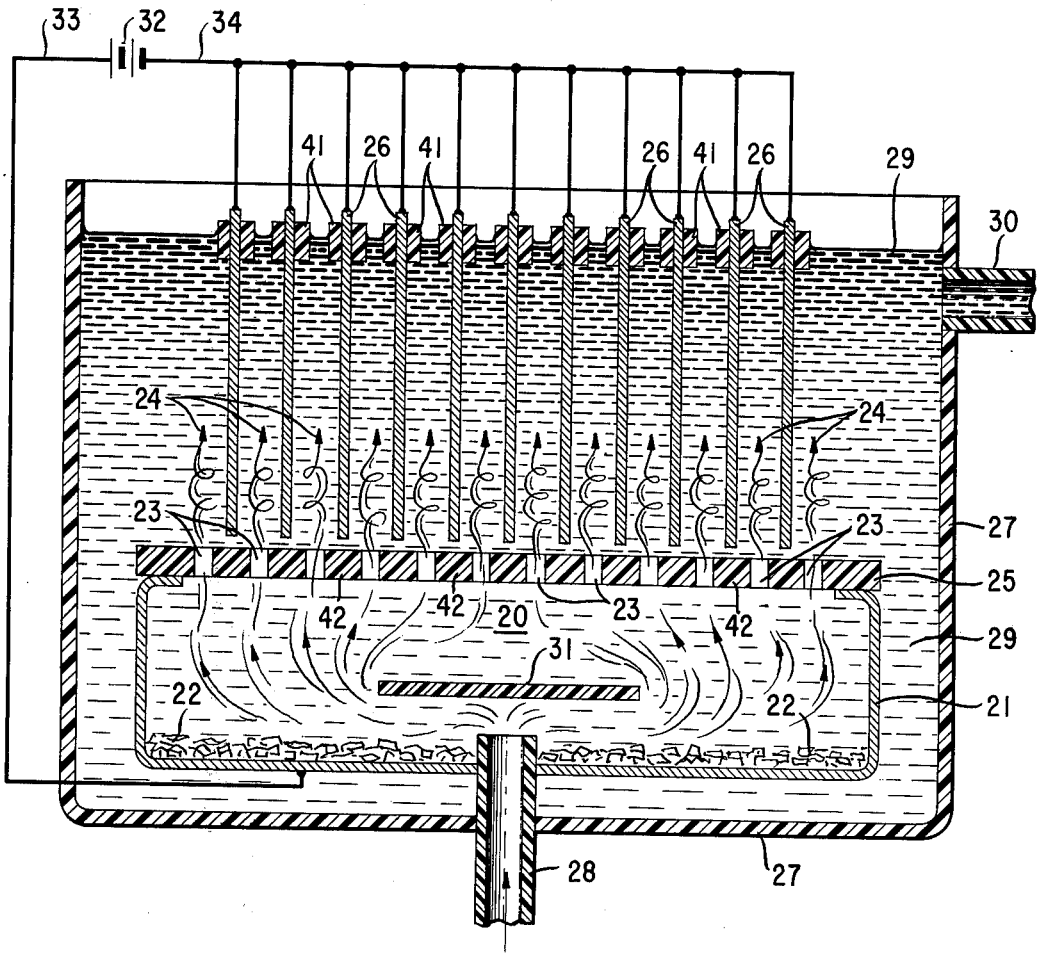
FIG. 2 is an elevational view in section of an exemplary electroplating apparatus including an anode plenum.

FIG. 2 shows an anode plenum 20 within an electroplating tank 27. The plenum 20 includes a metal box 21 and a perforated insulating partition 25 including flow orifices 23. It also includes inlet 28. The plating electrolyte 29 is continually introduced into the inlet 28 and is pumped out of the outlet 30. The box 21 is deep enough so that there is no significant fluid pressure difference across the partition 25 so that the fluid flow indicated between arrows 24 is as nearly as possible the same at each of the workpieces 26 being plated. Depending upon the location of the inlet 28 it may prove advantageous, at the option of the designer of the apparatus, to provide a baffle 31 in the vicinity of the inlet to further even out the fluid flow pattern. Metal pieces 22 are provided in the bottom of the box 21 for soluble anode plating processes. The anodic biasing of the plenum 20 and cathodic biasing of the workpieces 26 is schematically indicated by the battery 32 and associated electrical connections 33, 34.

Figure 3:
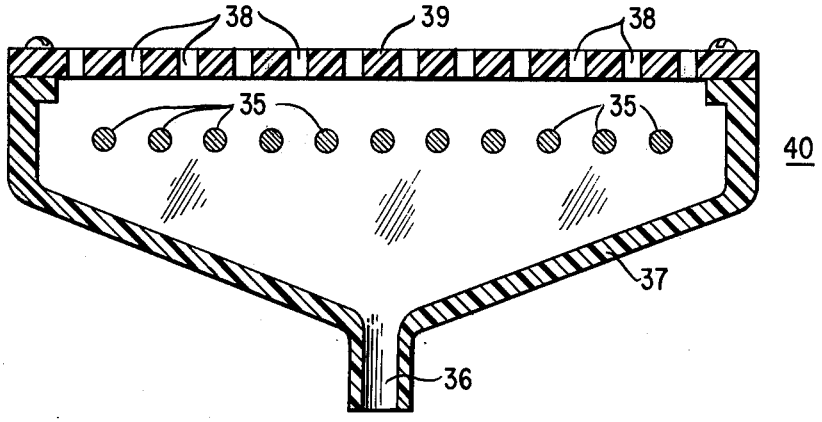
FIG. 3 is an elevational view in section of a further exemplary anode plenum.

In the sparging plenum of FIG. 3 the anodes 35 are incorporated entirely within the plenum 40. The electrolyte is pumped into the inlet 36 and restricted by the body of the plenum 37 to flow from the orifices 38 in the partition 39.

FIG. 2 also illustrates another utility of the device of the invention. If the workpieces 26 are planar and the orifices 23 are uniformly spaced slots, the workpieces 26 may be held by clamps 41 with the sharp edges directly over the lands 42 between the slots 23. Since the electrically insulating partition 25 is situated between the anode 21 and the workpieces 26 the lands 42 partially shield the sharp ends of the workpieces 26 and suppress the more rapid plating which would otherwise occur in the high field region of the sharp edges.

What is claimed is:

1. Plating apparatus comprising a sparging means for continually introducing plating solution into a plating tank from a position below the location of the articles to be plated CHARACTERIZED IN THAT the sparging means includes a sparging plenum consisting essentially of an anode structure, an electrically insulating partition possessing a regular array of uniformly space slots, which partition is disposed between the anode structure and the location of the articles to be plated, a plating solution inlet situated on the same side of the partition as the anode structure and flow restriction means for insuring that at least the principal part of the solution flowing into the tank from the inlet must flow through the partition to reach the position of the articles to be plated which apparatus also includes means for holding planar articles to be plated with one edge of each article adjacent to the land between succeeding slots.

2. Apparatus of claim 1 in which the anode structure includes an anode tray for holding pieces of consumable anode material.

3. Apparatus of claim 2 in which the anode tray forms at least one major surface of the sparging plenum.

4. Apparatus of claim 2 in which the sparging plenum includes a baffel adjacent to the inlet for promoting more uniform distribution of the plating solution within the sparging plenum.

* * * * *